US005582092A

United States Patent [19]

Nomura et al.

[11] Patent Number: 5,582,092

[45] Date of Patent: Dec. 10, 1996

[54] FULL STROKE POSITION SETTING MECHANISM FOR VARIABLE CAPACITY WOBBLE PLATE COMPRESSORS

[75] Inventors: Hiroshi Nomura; Kazuo Eitai; Minoru Kanaizuka; Hiroyuki Ishida, all of Saitama-ken, Japan

[73] Assignee: Zexel Corporation, Tokyo, Japan

[21] Appl. No.: 512,110

[22] Filed: Aug. 7, 1995

[30] Foreign Application Priority Data

Aug. 22, 1994 [JP] Japan ..... 6-219397

[51] Int. Cl.[6] ..... F01B 3/02

[52] U.S. Cl. ..... 92/12.2; 91/505; 417/222.2

[58] Field of Search ..... 91/499, 505; 92/12.2; 417/222.2; 74/60

[56] References Cited

U.S. PATENT DOCUMENTS 4,586,874 5/1986 Hiraga et al. ..... 417/222.2
4,732,544 3/1988 Kurosawa et al. ..... 417/222.2
5,063,829 11/1991 Takao et al. ..... 91/71

FOREIGN PATENT DOCUMENTS 5-83378 11/1993 Japan .
6-4376 1/1994 Japan .

*Primary Examiner*—F. Daniel Lopez
*Attorney, Agent, or Firm*—Frishauf, Holtz, Goodman, Langer & Chick

[57] ABSTRACT

A drive hub-receiving surface 40*c* of a thrust flange 40 is set substantially at a right angle to the axis of a shaft 5, whereby when the compressor drastically enters the maximum delivery quantity condition, an abutment portion 41*c* of a drive hub 41 substantially perpendicularly abuts on the drive hub-receiving surface 40*c* of the thrust flange 40. This prevents load from perpendicularly acting on the shaft 5, causing substantially no elastic deformation of the shaft 5. Further, under the maximum delivery quantity condition, the abutment portion 41*c* of the drive hub 41 perpendicularly abuts on the drive hub-receiving surface 40*c*, so that compression reaction forces acting from a piston 7 to the drive hub 41 are absorbed by the drive hub-receiving surface 40*c* of the thrust flange 40, thereby decreasing the vibration of the drive hub 41.

2 Claims, 8 Drawing Sheets

FULL STROKE POSITION SETTING MECHANISM FOR VARIABLE CAPACITY WOBBLE PLATE COMPRESSORS

BACKGROUND OF THE INVENTION

1. Field of the Invention

This invention relates to a full stroke position-setting mechanism for a variable capacity wobble plate compressor, and more particularly to a full stroke position-setting mechanism for a variable capacity wobble plate compressor which is capable of suppressing elastic deformation of a shaft of the compressor when the compressor is under the full stroke condition (maximum delivery quantity condition).

2. Description of the Prior Art

FIG. 8 shows in cross-section a variable capacity wobble plate compressor equipped with a conventional full stroke position-setting mechanism, which is proposed e.g. by Japanese Provisional Utility Model Publication (Kokai) No. 5-83378. FIG. 9 is an enlarged cross-section of the full stroke position-setting mechanism appearing in FIG. 8.

As shown in FIG. 8, the variable capacity wobble plate compressor equipped with the conventional full stroke position-setting mechanism is comprised of a shaft 5, a thrust flange 240 rigidly mounted thereon, a drive hub 241 rotatively mounted on the shaft 5 via a hinge ball 9, a link arm 42 connecting between one radial end of the drive hub 241 and one radial end of the thrust flange 240, and a wobble plate 10 mounted on the drive hub 241 and driven for wobbling motion by the rotation of the drive hub 241. The wobbling motion of the wobble plate 10 converts the rotation of the drive hub 241 into reciprocating motion of a piston 7 which is connected to the wobble plate 10 by a rod 11.

In the variable capacity wobble plate compressor, as pressure within the crankcase 8 decreases, the inclination angle of the wobble plate 10 increases, so that as shown in FIG. 9, an abutment portion 241*c* of the drive hub 241 abuts on a drive hub-receiving surface 240*c* formed on the periphery of a boss 240*b* of the thrust flange 240, whereby the compressor is placed into the full stroke condition (the maximum delivery quantity condition).

On the other hand, as the pressure within the crankcase 8 increases, the inclination angle of the wobble plate 20 decreases, and the abutment portion 241*c* of the drive hub 241 becomes away from the drive hub-receiving surface 240*c* on the periphery of the boss 240*b* of the thrust flange 240, whereby the compressor is placed into the minimum stroke condition (minimum delivery quantity condition).

However, since the drive hub-receiving surface 240 is in parallel with the axis of the shaft 5, if the compressor suddenly enters the maximum delivery quantity condition, a large load acts on the shaft 5 to cause elastic deformation of the shaft 5, which can shift points of the center of gravity of rotors of the compressor, such as the thrust flange 240 and the drive hub 241, causing vibrations and noise. In addition, although another full stroke position-setting mechanism has been proposed e.g. by Japanese Provisional Utility Model Publication (Kokai) No. 6-4376 in which the drive hub-receiving surface 240*c* is inclined relative to the axis of the shaft 5, this mechanism cannot prevent occurrence of vibrations and noise, either.

Further, intermittent occurrences of compression reaction forces cause vibrations of the drive hub 241 (five vibrations per one rotation in the case of a five-cylinder type compressor), which can cause fretting, i.e. the phenomenon of exfoliation of surfaces of associated members. This phenomenon is liable to occur between the thrust flange 240, the link arm 42, and the drive hub 241, as well as between the shaft 5, the hinge ball 9, and the drive hub 241. This brings about abnormal wear, noise, and finally, locking of the compressor.

SUMMARY OF THE INVENTION

It is an object of the invention to provide a full stroke position-setting mechanism for a variable capacity wobble plate compressor which is capable of suppressing elastic deformation of a shaft of the compressor when the compressor suddenly enters the maximum delivery quantity condition, as well as suppressing vibration of a drive hub caused by compression reaction forces under the maximum delivery quantity condition, thereby preventing noise and abnormal wear.

To attain the above object, the invention provides a full stroke position-setting mechanism for a variable capacity wobble plate compressor including a wobble plate-housing chamber, a rotational shaft rotatively extending through the wobble plate-housing chamber, a thrust flange rigidly mounted on the rotational shaft, a drive hub rotatively mounted on the rotational shaft, a link arm connecting between one radial end portion of the thrust flange and one radial end portion of the drive hub, a wobble plate mounted on the drive hub for being driven for wobbling motion by rotation of the drive hub, a piston for compressing a refrigerant by reciprocating motion thereof, and a rod connecting between the piston and the wobble plate, the thrust flange having a drive hub-receiving surface opposed to the drive hub at another radial end thereof on which another radial end of the drive hub abuts, wherein when pressure within the wobble plate-housing chamber is above a predetermined value, an inclination angle of the wobble plate increases to thereby cause the another radial end of the drive hub to abut on the drive hub-receiving surface of the thrust flange, thereby setting the maximum stroke of the piston, whereas when the pressure within the wobble plate-housing chamber is below the predetermined value, the inclination angle of the wobble plate decreases to thereby cause the another radial end of the drive hub to become away from the drive hub-receiving surface of the thrust flange thereby setting the minimum stroke of the piston.

The full stroke position-setting mechanism according to the invention is characterized in that the drive hub-receiving surface of the thrust flange is substantially at a right angle to the axis of the rotational shaft.

According to this invention, when the compressor drastically enters the maximum delivery quantity condition, the another radial end of the drive hub substantially perpendicularly abuts on the drive hub-receiving surface of the thrust flange. This prevents load from perpendicularly acting on the rotational shaft, causing substantially no elastic deformation of the shaft. Further, under the maximum delivery quantity condition, the another radial end of the drive hub perpendicularly abuts on the drive hub-receiving surface, so that compression reaction forces acting from the piston to the drive hub are absorbed by the drive hub-receiving surface of the thrust flange, thereby decreasing the vibration of the drive hub. As a result, it is possible to prevent noise and abnormal wear.

Preferably, the drive hub-receiving surface is formed by a plurality of surface portions projected from the another radial end portion of the thrust flange, and the drive hub has a projected part formed on the another radial end of the drive hub, whereby the projected part of the drive hub is sandwiched between the plurality of surface portions projected from the another radial end portion of the thrust flange when the another radial end of the drive hub abuts on the drive hub-receiving surface of the thrust flange.

The above and other objects, features and advantages of the present invention will become more apparent from the following description taken in conjunction with the accompanying drawings.

DETAILED DESCRIPTION OF THE PREFERRED EMBODIMENTS

Now, the invention will now be described with reference to drawings showing preferred embodiments thereof.

Figure 2:
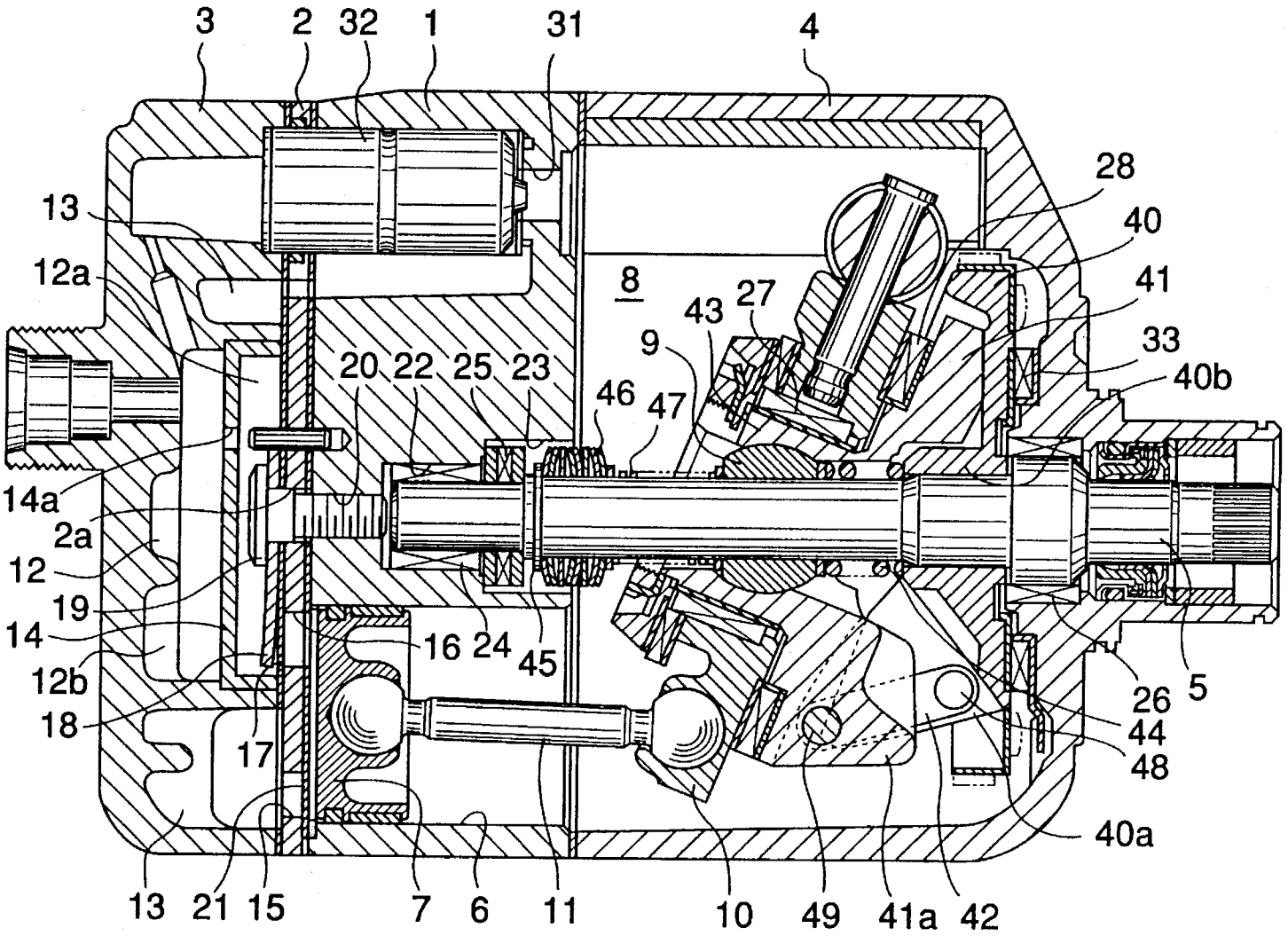
FIG. 2 is a longitudinal cross-sectional view showing a variable capacity wobble plate compressor incorporating the FIG. 1 full stroke position-setting mechanism.

Referring first to FIG. 2, there is shown a variable capacity wobble plate compressor equipped with a full stroke position-setting mechanism according to a first embodiment of the invention. The compressor is comprised of a cylinder block 1, a rear head 3 rigidly fixed to one end face of the cylinder block 1 via a valve plate 2, and a front head 4 rigidly fixed to the other end face of the cylinder block 1.

The cylinder block 1 is formed with a plurality of cylinder bores which extend longitudinally at predetermined circumferentially-spaced intervals around a shaft (rotational shaft) 5. Each cylinder bore 6 has a piston 7 slidably received therein.

The front head 4 has a crankcase (wobble plate-receiving chamber) 8 formed therein, in which a wobble plate 10 is received for wobbling motion about a hinge ball 9 fitted on the shaft 5, in a manner interlocked with rotation of the shaft 5.

The rear head 3 is formed therein with a discharge pressure chamber 12 and a suction chamber 13 formed outward of the discharge pressure chamber 12. The discharge pressure chamber 12 is divided by a partition 14 into discharge spaces 12*a*, 12*b* which are communicated with each other via at least one restriction hole 14*a*.

The valve plate 2 is formed with outlet ports 16 which communicate respective cylinder bores 6 with the discharge space 12*a*, and inlet ports 15 which communicates respective cylinder bores 6 with the suction chamber 13, both at respective predetermined circumferentially-spaced intervals. Each outlet port 16 is caused to open and close by a delivery valve 17 which is fixed to one end face of the valve plate 2 on the rear head side together with a valve retainer 18 by a bolt 19. The bolt 19 is screwed into a screw hole 20 formed in the cylinder block 1 via a central hole 2*a* formed through the valve plate 2. The inlet port 15 is opened and closed by a suction valve 21 which is arranged between the valve plate 2 and the cylinder block 1.

The screw hole 20, a small diameter hole 22, and a larger diameter hole 23 are formed in the center of the cylinder block 1 along the longitudinal axis thereof such that they are communicated with each other. In the small diameter hole 22, a radial bearing 24 is received, and in the large diameter hole 23, a thrust bearing 25 is received. The radial bearing 24 and the thrust bearing 25 rotatively support a rear head-side end of the shaft 5, and a radial bearing 26 arranged in the front head 4 rotatively supports a front head-side end of the shaft 5.

Further, the cylinder block 1 is formed with a communication passage 31 communicating the suction chamber 13 with the crankcase 8. A pressure control valve 32 is provided in an intermediate portion of the communication passage 31 for controlling pressure within the suction chamber 13 and the pressure within the crankcase 8.

Further, the shaft 5 has a thrust flange 40 rigidly fitted thereon, and a drive hub 41 rotatively mounted thereon via the hinge ball 9. The thrust flange 40 is supported by an inner wall of the front head 4 by way of a thrust bearing 33. One radial end of the thrust flange 40 and one radial end of the drive hub 41 are connected to each other by a link arm 42, as described in detail hereinafter, whereby the rotation of the shaft 5 is transmitted from the thrust flange 40 to the drive hub 41. Mounted on the drive hub 41 via bearings 27, 28 is the wobble plate 10. With rotation of the shaft 5, the thrust flange 40 and the drive hub 41 rotate in unison with the shaft 5, and as the drive hub 41 rotates, the wobble plate 10 performs wobbling motion about the hinge ball 9. The wobble plate 10 is connected via a connecting rod 11 to the piston 7, whereby the wobbling motion of the wobble plate to is transmitted via the connecting rod 11 to the piston 7, to thereby transform the wobbling motion into a linear reciprocating motion of the piston 7.

A spring 44 is fit on the shaft 5 between the hinge ball 9 and a boss 40*b* of the thrust flange 40 for urging the hinge ball 9 toward the cylinder block 1. Further, a stopper 45 is formed around a portion of the shaft 5 located within the cylinder block 1, and a plurality of coned disc springs 46 and a coiled spring 47 are fit on the shaft 5 between the stopper 45 and the hinge ball 9 in the mentioned order for urging the hinge ball 9 toward the thrust flange 40.

Figure 3:
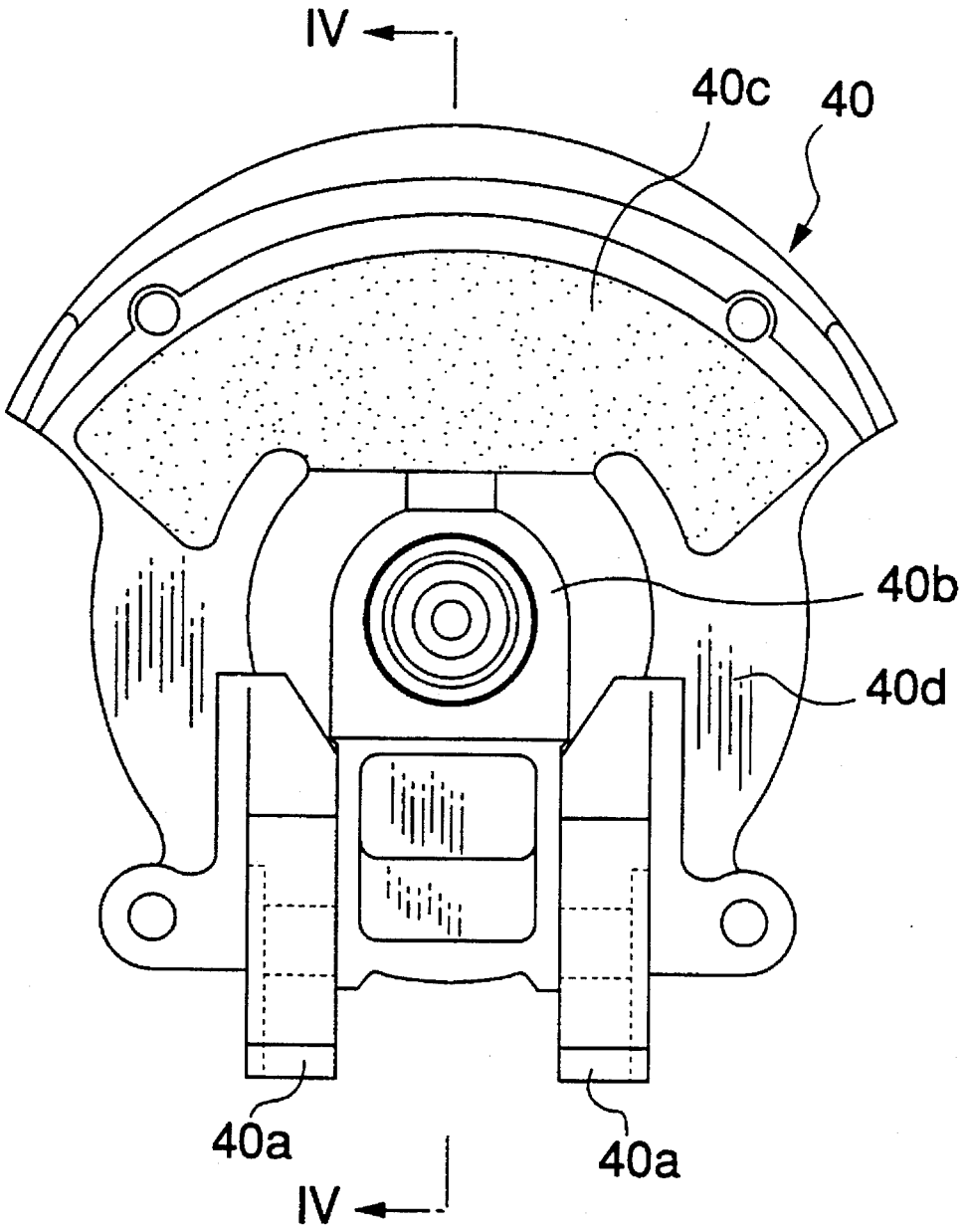
FIG. 3 is a view showing a surface of a thrust flange opposed to a drive hub.
Figure 4:
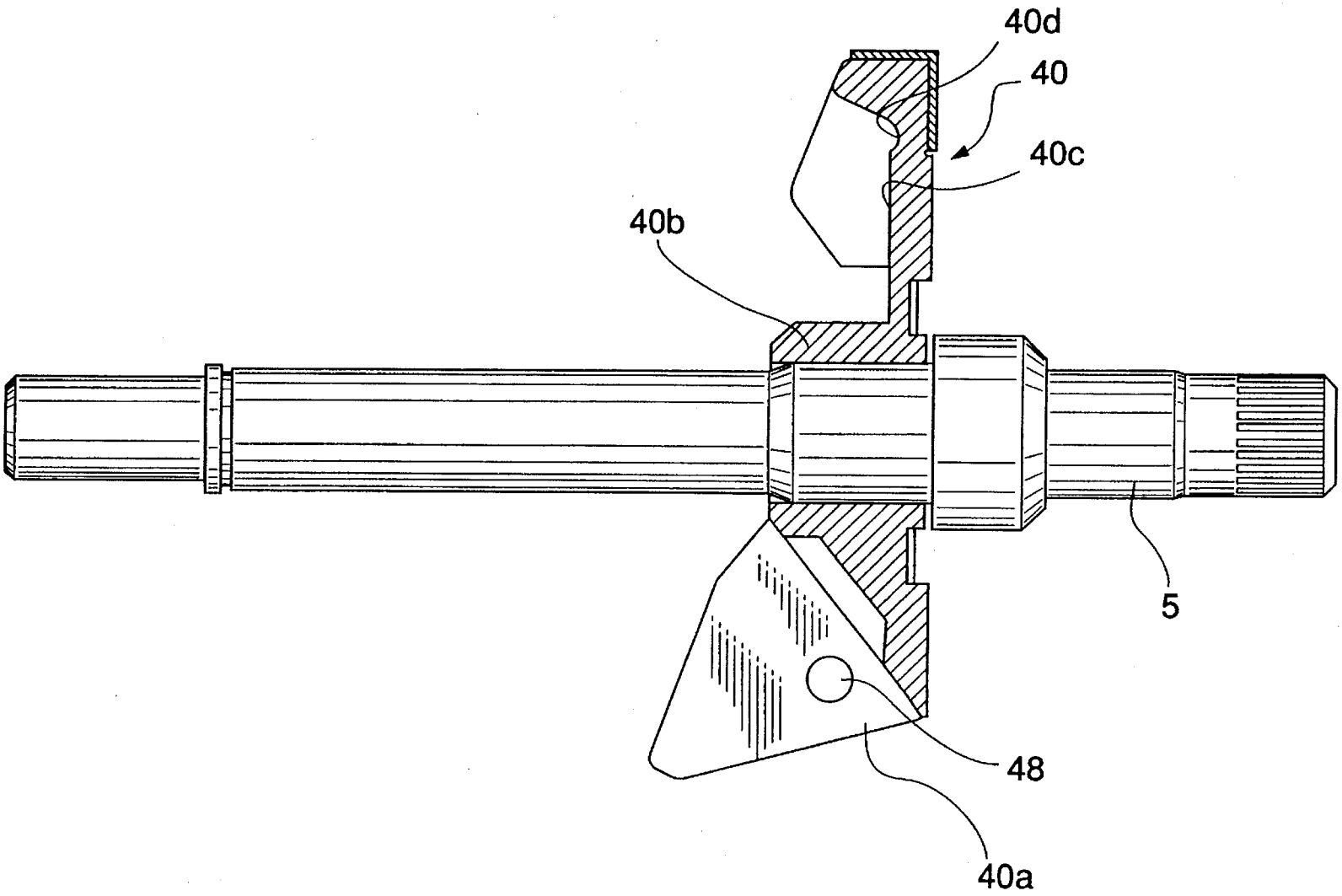
FIG. 4 is a cross-sectional view taken along lines IV—IV of FIG. 3.
Figure 5A:
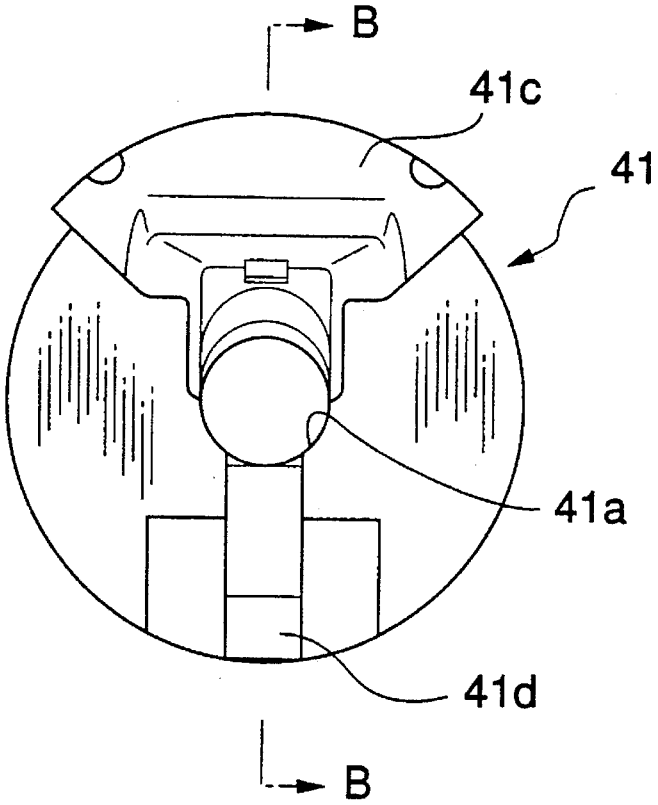
FIG. 5A and FIG. 5B are views which are useful in describing a configuration of the drive hub.
Figure 5B:
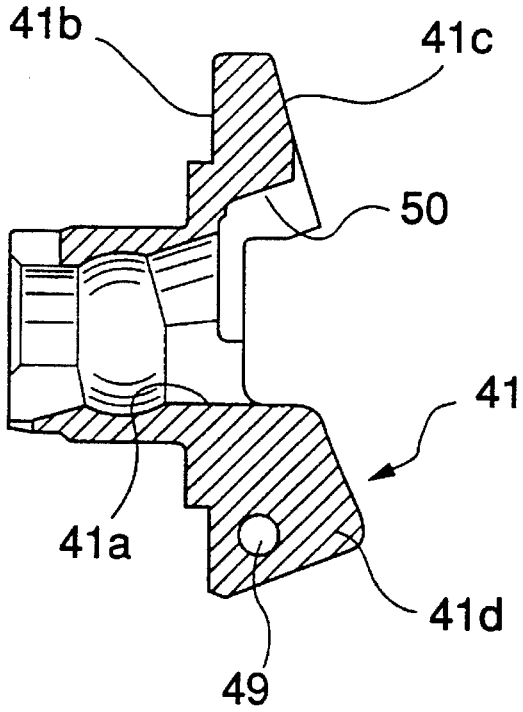

FIG. 3 shows a surface of the thrust flange 40 opposed to the drive hub 41, FIG. 4 a cross-section taken along lines IV—IV of FIG. 3, FIG. 5A a surface of the drive hub 41 opposed to the thrust flange 40, and FIG. 5B a cross-section taken along lines B—B of FIG. 5A.

The thrust flange 40 is formed with a pair of projections 40*a*, 40*a* opposed to each other at the one radial end thereof, and a pin 48 extends between the projections 40*a*, 40*a* for linking the thrust flange 40 to the link arm 42. The thrust flange 40 has another radial end thereof formed with a drive hub-receiving surface 40*c* opposed to the drive hub 41 for receiving an abutment portion 41*c* of the drive hub 41. The drive hub-receiving surface 40*c* is arranged at a right angle to the axis of the shaft 5, and as shown in FIG. 4, the drive hub-receiving surface 40*c* is projected or rises toward the drive hub 41 compared with a drive hub-opposed surface 40*d*. Further, the drive hub-receiving surface 40*c* has a predetermined side-to-side length as viewed from FIG. 3 whereby even when the abutment portion 41*c* of the drive hub 41 slides in a rotational direction, surface contact between the drive hub-receiving surface 40*c* and the abutment portion 41*c* of the drive hub 41 is preserved. The thrust bearing 33 is arranged at a back side of the drive hub-receiving surface 40*c* (see FIG. 2).

As shown in FIGS. 5A and 5B, the drive hub 41 has one radial end thereof formed with a projection 41*d* on which is formed a pin 49 for fitting the link arm 42 thereon. The abutment portion 41*c* is formed on another radial end of the drive hub 41 for abutting on the drive hub-receiving surface 40*c* when the compressor is under the maximum delivery quantity condition. The abutment portion 41*c* is largely cut out at a radially inner portion thereof as shown in FIG. 5B to form a gap 50 for avoiding contact with periphery of the boss 40*b* of the thrust flange 40. Further, the hinge ball 9 is rotatively received in an intermediate portion of the central hole 41*a* of the drive hub 41. The drive hub 41 is formed with a shoulder on a surface thereof opposed to the wobble plate 10, and the thrust bearing 28 is arranged on a lower step 41*b* of the surface.

The link arm 42 has one end rotatively linked to the pin 48 and the other end rotatively linked to the pin 49. As the pressure within crankcase 8 varies, the drive hub 41 abuts on the drive hub-receiving surface 40*c* of the thrust flange 40 or becomes away therefrom.

Next, the operation of the variable capacity wobble plate compressor will be described.

When torque of an engine, not shown, installed on an automotive vehicle is transmitted to the shaft 5, the thrust flange 40 and the drive hub 41 rotate in unison with the shaft 5, whereby the wobble plate 10 performs wobbling motion. The wobbling motion of the wobble plate 10 causes reciprocating motion of the piston 7 in the cylinder bore 6, which causes variation in the actual capacity of the cylinder bore 6. As the actual capacity of the cylinder bore 6 varies, refrigerant gas is drawn in, compressed, and delivered. Thus, a high-pressure refrigerant gas is delivered in a volume commensurate with the inclination angle of the wobble plate 10.

As a thermal load decreases, the pressure-regulating valve 32 closes the communication passage 31 to increase the pressure within the crankcase 8, so that the inclination angle of the wobble plate 10 decreases, resulting in a shortened stroke of the piston 7, to reduce the delivery quantity of the refrigerant gas.

Figure 1:
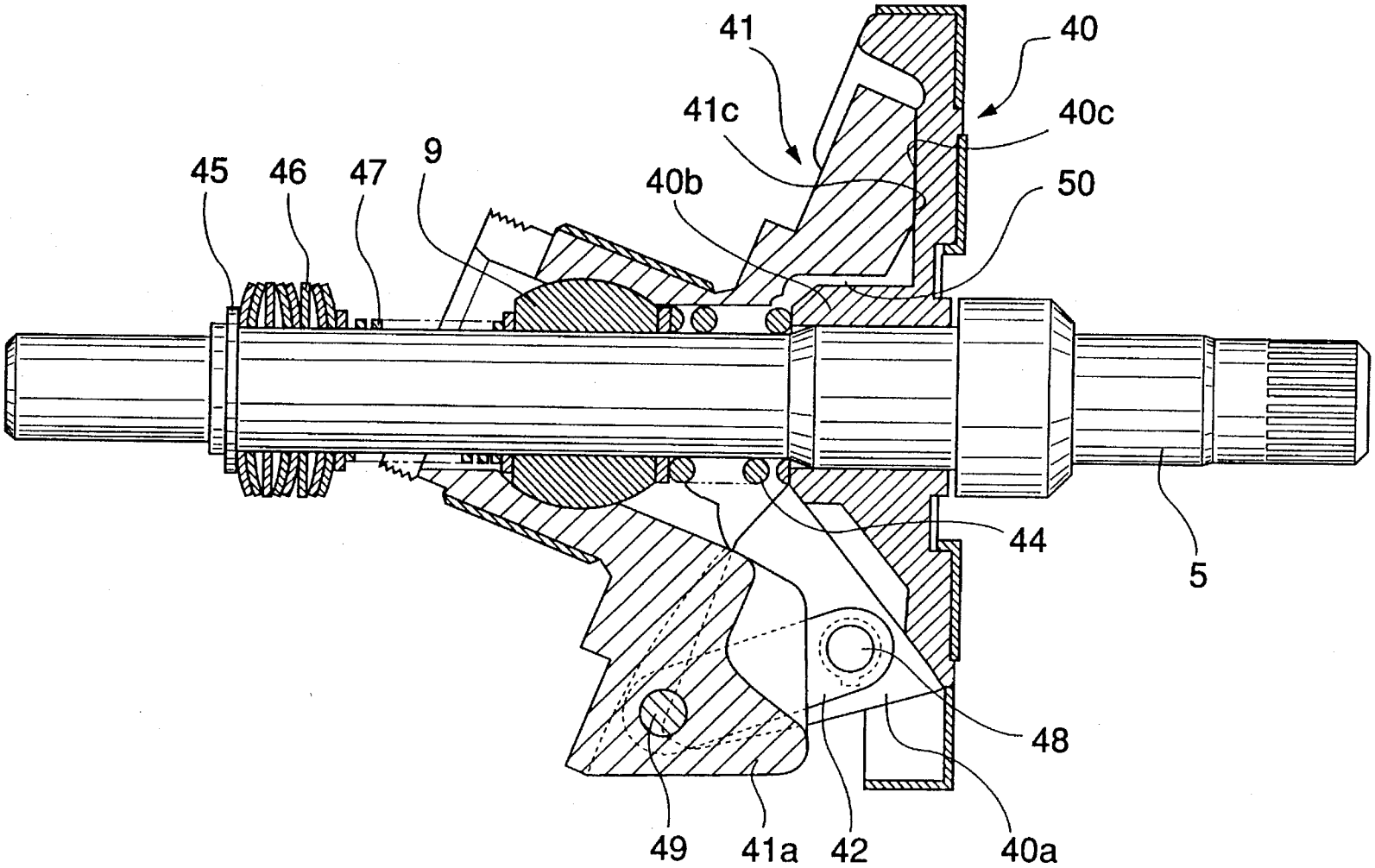
FIG. 1 is a cross-sectional view showing a full stroke position-setting mechanism according to a first embodiment of the invention.

As a thermal load increases, the pressure-regulating valve 32 opens the communication passage 31 to decrease the pressure within the crankcase 8, so that, the inclination angle of the wobble plate 10 increases, resulting in a lengthened stroke of the piston 7. When the drive hub 41 inclines toward the thrust flange 40 together with the wobble plate 10, the abutment portion 41*c* of the drive hub 41 abuts on the drive hub-receiving surface 40*c* of the thrust flange 40, thereby setting the maximum stroke of the piston 7. In this state, the drive hub 41 is not brought into contact the boss 40*b* of the thrust flange 40 (see FIG. 1).

The drive hub-receiving surface 40*c* of the thrust flange 40 is arranged substantially at a right angle to the axis of the shaft 5, whereby when the compressor drastically enters the maximum delivery quantity condition, the abutment portion 41*c* of the drive hub 41 substantially perpendicularly abuts on the drive hub-receiving surface 40*c* of the thrust flange 40. This prevents load from perpendicularly acting on the shaft 5, causing substantially no elastic deformation of the shaft 5. Further, under the maximum delivery quantity condition, since the abutment portion 41*c* of the drive hub 41 perpendicularly abuts on the drive hub-receiving surface 40*c*, compression reaction force transmitted from the piston 7 to the drive hub 41 is absorbed by the drive hub-receiving surface 40*c* of the thrust flange 40, thereby decreasing the vibration of the drive hub 41.

According to the full stroke position-setting mechanism for a variable capacity wobble plate compressor, according to the first embodiment, it is possible to suppress elastic deformation of the shaft 5 when the compressor suddenly enters the maximum delivery quantity condition, and at the same time prevent the compression reaction force from causing vibration of the drive hub 41 under the maximum delivery quantity condition, thereby preventing noise and abnormal wear of associated component parts of the compressor. Further, since the abutment portion 41*c* of the drive hub 41 and the drive hub-receiving surface 40*c* of the thrust flange 40 are less liable to wear, it is not necessary to carry out high-frequency quenching which has been carried out by the prior art, thereby facilitating machining of the compressor.

Figure 6:
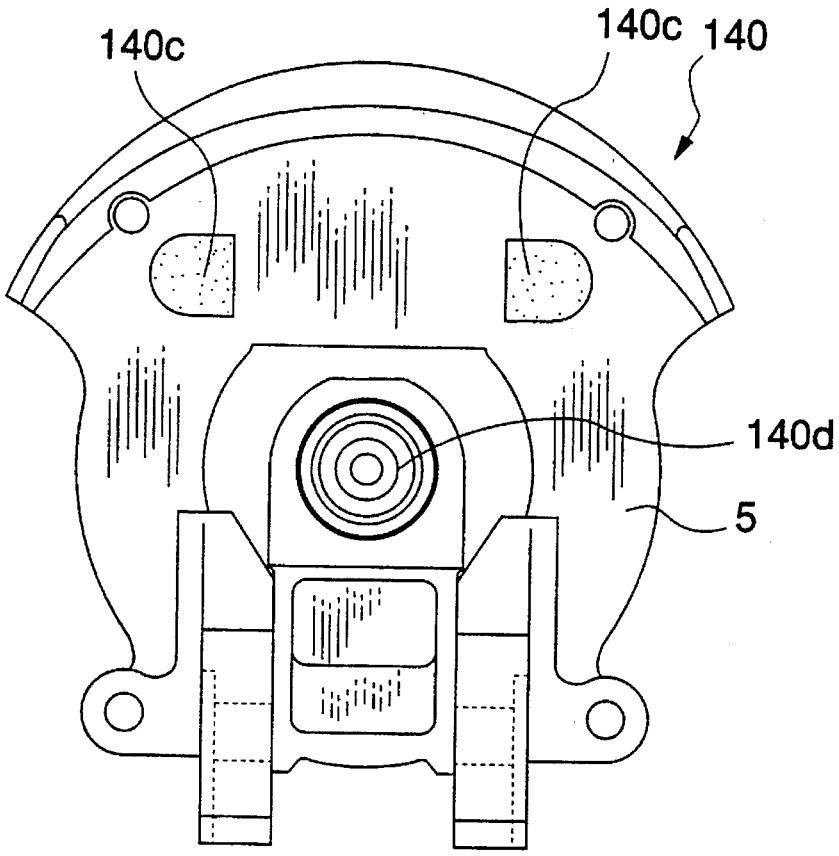
FIG. 6 is a view showing a surface of a thrust flange of a full stroke position-setting mechanism according to a second embodiment of the invention.
Figure 7:
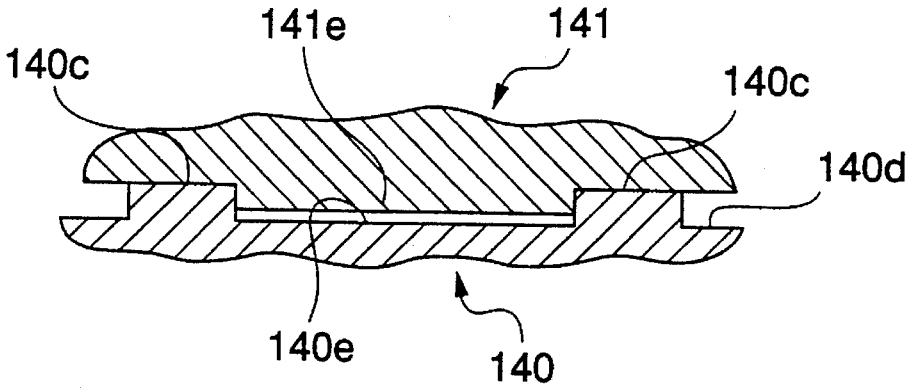
FIG. 7 is a cross-sectional view showing the thrust flange and a drive hub in a fitted state of the full stroke position-setting mechanism according to the second embodiment.
Figure 8:
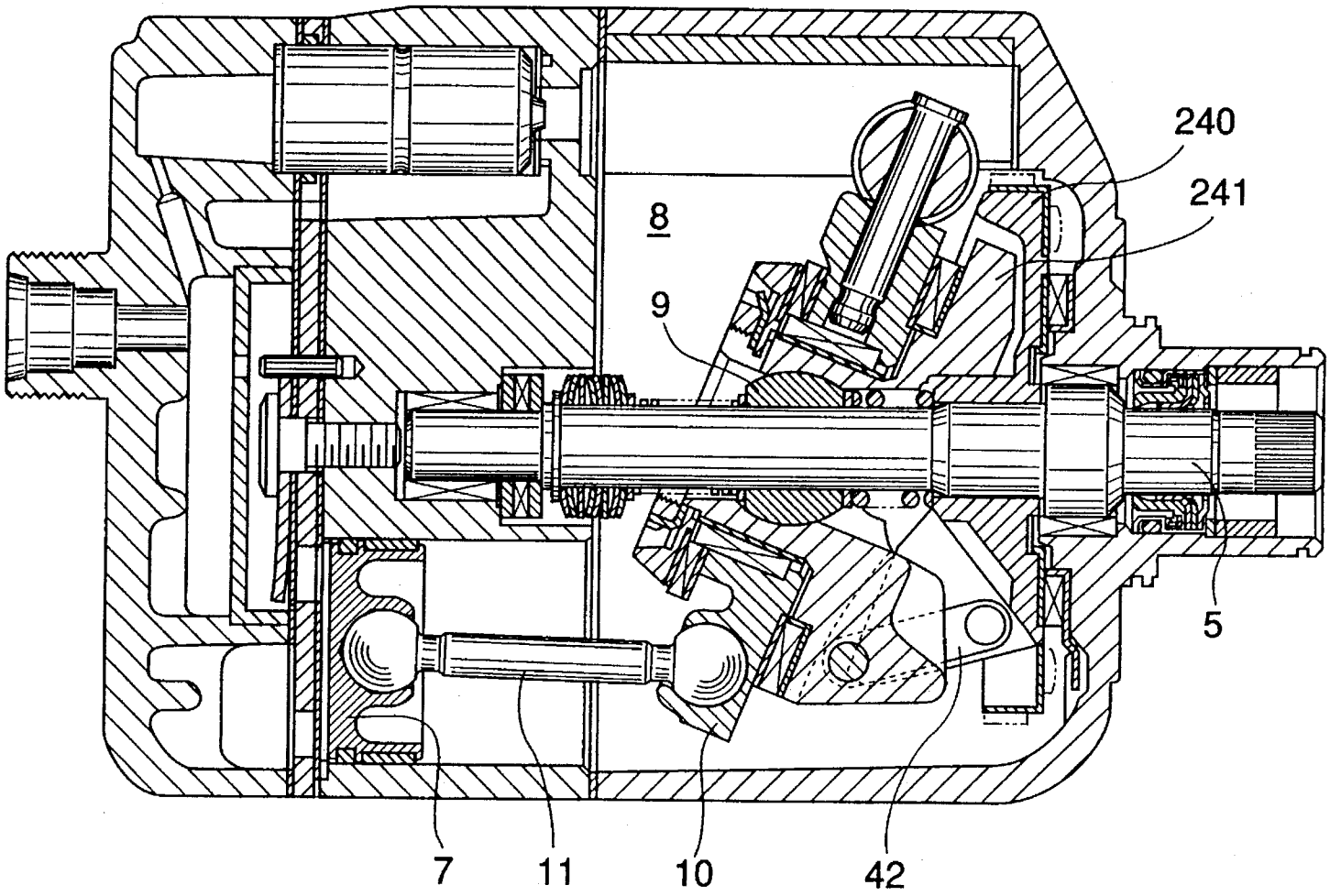
FIG.8 PRIOR ART
FIG. 8 is a cross-sectional view showing a variable capacity wobble plate compressor equipped with a conventional full stroke position-setting mechanism.
Figure 9:
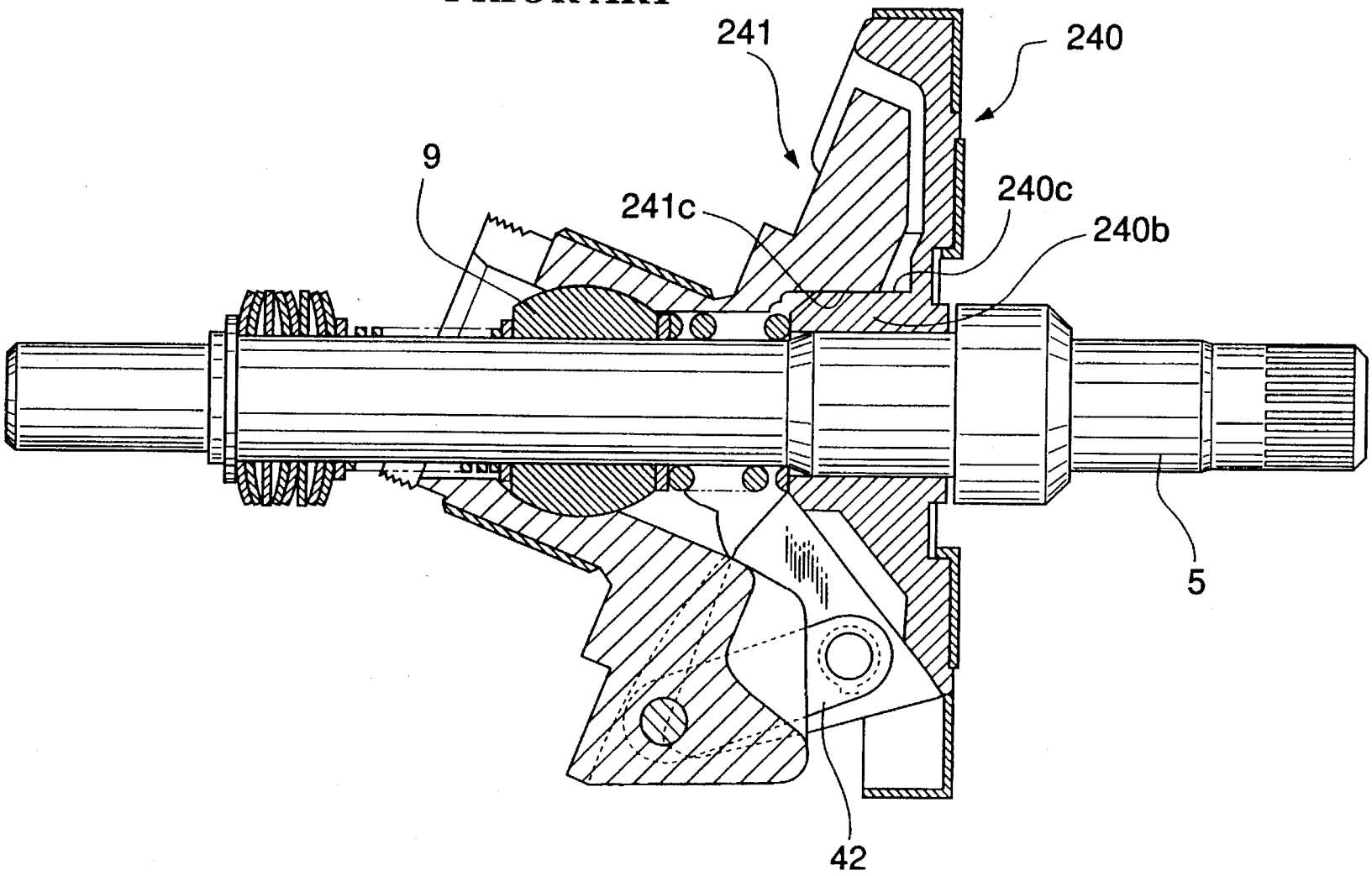
FIG.9 PRIOR ART
FIG. 9 is an enlarged cross-sectional view showing the full stroke position setting mechanism appearing in FIG. 8.

FIG. 6 shows a surface of a thrust flange opposed to a drive hub of a full stroke position-setting mechanism according to a second embodiment of the invention. FIG. 7 shows the thrust flange and the drive hub in a fitted state in cross-section. Detailed description of component parts and elements identical to those of the first embodiment will be omitted.

This embodiment is distinguished from the first embodiment in which the drive hub-receiving surface 40*c* having a large area is provided in the surface 40*d* of the thrust flange 40 opposed to the drive hub 41, in that two drive hub-receiving surfaces 140*c*, 140*c* are provided at predetermined space intervals in a surface 140*d* of a thrust flange 140, and a projected part 141*e* is formed on a surface 141*d* of the drive house 141 opposed to the thrust flange, for being fitted in a recess 140*e* formed between the drive hub-receiving surfaces 140*c*, 140*c*.

Thus, as shown in FIG. 7, when the wobble plate 10 is in its position of the maximum delivery quantity condition, the projected part 141*e* provided on the surface 141*d* of the drive hub 141 opposed to the thrust flange 140 is caused to be fitted in the recess 140*e* formed between the drive hub-receiving surfaces 140*c*, 140*c*. In this embodiment, the sum of width or crosswise lengths of the drive hub-receiving surfaces 140*c*, 140*c* is set to a predetermined value (e.g. 10 mm) or longer.

According to the second embodiment, in addition to effects obtained by the first embodiment, it is possible to obtain the following effects: the sum of the areas of the two drive hub-receiving surfaces 40*c* is much smaller than the area of the drive hub-receiving surface 40*c* appearing in FIG. 3, so that the area to be machined is reduced, facilitating machining, and when the abutment portion 141*c* of the drive hub 141 abuts on the thrust flange 140, the sliding operation of the drive hub 141 in the rotational direction is restricted to lessen load applied to the link arm 42, thereby making it possible to prevent breakage of the link arm 42.

What is claimed is:

1. In a full stroke position-setting mechanism for a variable capacity wobble plate compressor including a wobble plate-housing chamber, a rotational shaft rotatively extending through said wobble plate-housing chamber, said rotational shaft having an axis, a thrust flange rigidly mounted on said rotational shaft, a drive hub rotatively mounted on said rotational shaft, a link arm coupled between one radial end portion of said thrust flange and one radial end portion of said drive hub, a wobble plate mounted on said drive hub for being driven for wobbling motion by rotation of said drive hub, a piston for compressing a refrigerant by reciprocating motion thereof, and a rod coupled between said piston and said wobble plate, said thrust flange having a drive hub-receiving surface opposed to said drive hub at another radial end thereof on which another radial end of said drive hub abuts, wherein when pressure within said wobble plate-housing chamber is above a predetermined value, an inclination angle of said wobble plate increases to thereby cause said another radial end of said drive hub to abut on said drive hub-receiving surface of said thrust flange, thereby setting a maximum stroke of said piston, whereas when said pressure within said wobble plate-housing chamber is below said predetermined value, said inclination angle of said wobble plate decreases to thereby cause said another radial end of said drive hub to become away from said drive hub-receiving surface of said thrust flange, thereby setting a minimum stroke of said piston, the improvement wherein:

said drive hub-receiving surface of said thrust flange is substantially at a right angle to the axis of said rotational shaft;

said drive hub-receiving surface comprises a plurality of surface portions projected from said another radial end portion of said thrust flange; and said drive hub has a projected part formed on said another radial end of said drive hub, whereby said projected part of said drive hub is sandwiched between said plurality of surface portions projected from said another radial end portion of said thrust flange when said another radial end of said drive hub abuts on said drive hub-receiving surface of said thrust flange.

2. A full stroke position-setting mechanism for a variable capacity wobble plate compressor according to claim 1, wherein:

said projected part of said drive hub comprises a single projected part; and the number of said plurality of surface portions of said drive hub-receiving surface is two.

* * * * *